US006319051B1

(12) United States Patent
Chang et al.

(10) Patent No.: US 6,319,051 B1
(45) Date of Patent: Nov. 20, 2001

(54) ELECTRIC CONNECTOR WITH A LIGHT PENETRABLE SOCKET SHELL

(75) Inventors: Chih-Kai Chang, Sanchung; Huan-Ching Tsen, Chupei, both of (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 09/689,691

(22) Filed: Oct. 13, 2000

(30) Foreign Application Priority Data

May 23, 2000 (TW) ..... 089208726

(51) Int. Cl.[7] ..... H01R 3/00
(52) U.S. Cl. ..... 439/490; 439/488
(58) Field of Search ..... 439/488, 489, 439/490, 676, 607, 541.5, 344, 571–573, 357, 358, 577

(56) References Cited

U.S. PATENT DOCUMENTS 4,099,159 * 7/1978 Windisch ..... 340/134
5,727,965 * 3/1998 Yagi ..... 439/488 X
5,741,152 * 4/1998 Boutros ..... 439/490
5,989,069 * 11/1999 Tan ..... 439/686 X
6,012,936 * 1/2000 Siemon et al. ..... 439/188
6,120,318 * 9/2000 Reed et al. ..... 439/490
6,132,260 * 10/2000 Wu ..... 439/676
6,174,198 * 1/2001 Wu et al. ..... 439/541.5

* cited by examiner

*Primary Examiner*—Brian Sircus
*Assistant Examiner*—Son V. Nguyen
(74) *Attorney, Agent, or Firm*—Bacon & Thomas

(57) ABSTRACT

An electric connector in which an socket shell is installed in a housing to hold a terminal holder inside the housing and a set of terminals in the terminal holder and adapted to receive an electric plug, the socket shell being made of light penetrable material and, having a visible front side adapted to receive an electric plug and electric light emitting means, for example, LEDs installed in a rear side thereof and adapted to emit light through the visible front side to indicate operation of the electric connector.

5 Claims, 6 Drawing Sheets

ELECTRIC CONNECTOR WITH A LIGHT PENETRABLE SOCKET SHELL

BACKGROUND OF THE INVENTION

The present invention relates to electric connectors and, more particularly, to such an electric connector, which comprises a socket shell mounted inside a housing to hold a terminal holder and a set of terminals in the terminal holder, and light emitting means installed in the rear side of the socket shell and adapted to emit light through the visible front side of the socket shell to indicate operation of the electric connector.

Various electric connectors for data transmission between a computer and the telephone line are well known. However, regular electric connectors for this purpose have no indicator means to indicate normal function during operation. There are also known electric connectors with indicator lights. These electric connectors with indicator lights include three types, namely, the first type in which light emitting diodes are directly installed in the visible front side of the shell; the second type in which light emitting diodes are mounted on the inside and light guide means is provided to guide light from the light emitting diodes to the visible front side (see FIGS. 5 and 6); the third type in which light emitting diodes are directly welded to a circuit board at the bottom of the housing and light guide means is provided to guide light from the light emitting diodes to the visible front side of the electric connector (see FIGS. 7 and 8). These three types of electric connectors still have drawbacks.

1. According to the first type, the installation procedure of the light emitting diodes is complicated. When mounted in the housing, the pins of the light emitting diodes must be welded to respective contacts of the circuit board. Because there is a distance between the light emitting diodes and the circuit board, the pins of the light emitting diodes must be extended.

2. According to the second type, the use of light guide means greatly increases the manufacturing cost, and much light energy is lost when transmitted through the light guide means to the visible front side.

3. According to the third type, the use light guide means greatly increases the manufacturing cost, and much light energy is lost when transmitted through the light guide means to the visible front side.

SUMMARY OF THE INVENTION

The invention has been accomplished to provide an electric connector, which eliminates the aforesaid drawbacks. According to the present invention, the electric connector comprises an electrically insulative housing, and a socket shell installed in a housing to hold a terminal holder inside the housing and a set of terminals in the terminal holder and adapted to receive an electric plug. The socket shell is made of light penetrable material, having a visible front side adapted to receive an electric plug and electric light emitting means, for example, LEDs installed in a rear side thereof and adapted to emit light through the visible front side to indicate operation of the electric connector. Because the socket shell admits light, light energy is directly transmitted from the LEDs to the visible front side of the socket shell during operation of the electric connector.

DETAILED DESCRIPTION OF THE PREFERRED EMBODIMENT

Figure 1:
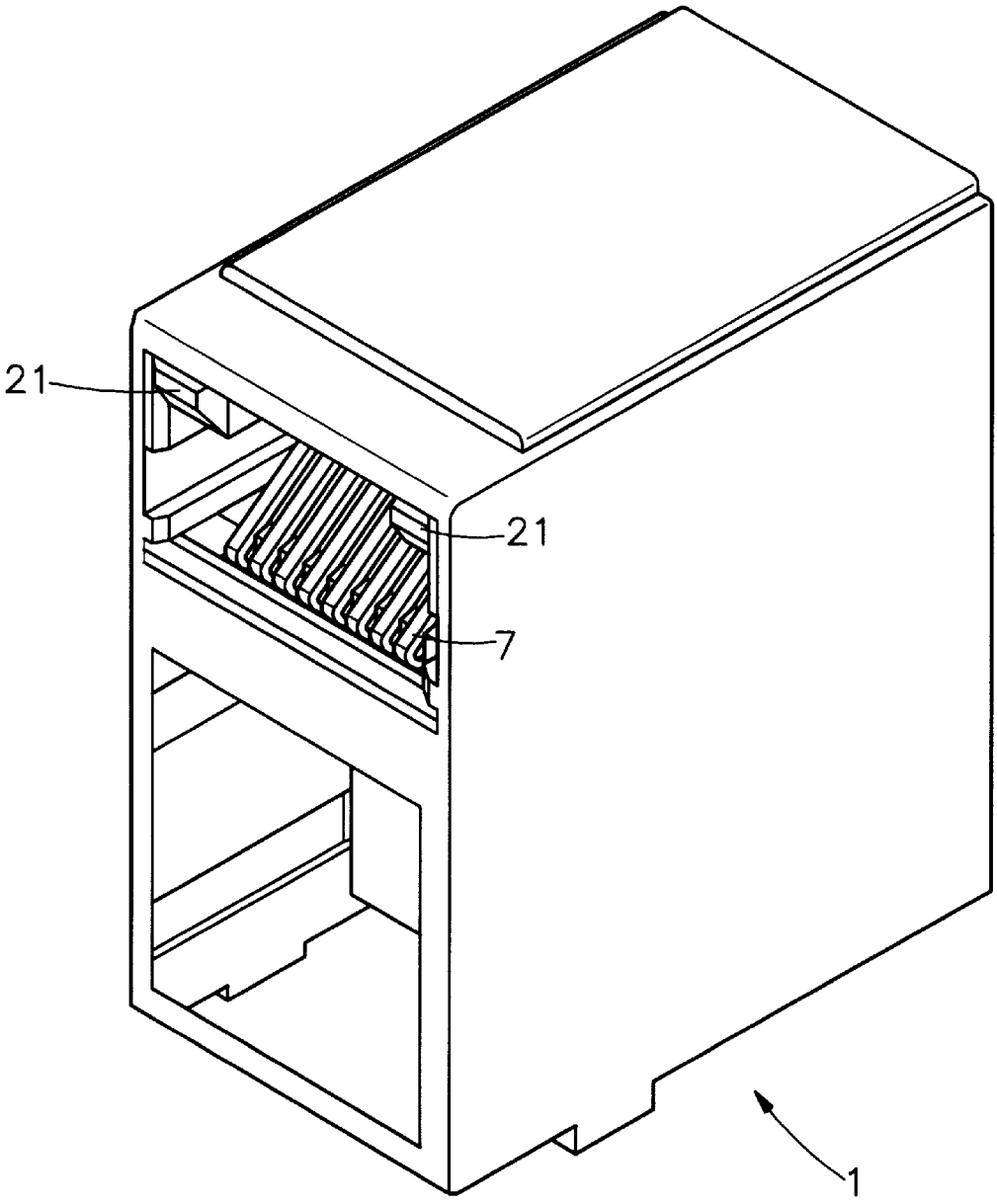
FIG. 1 is an oblique front side view of an electric connector according to the present invention.
Figure 2:
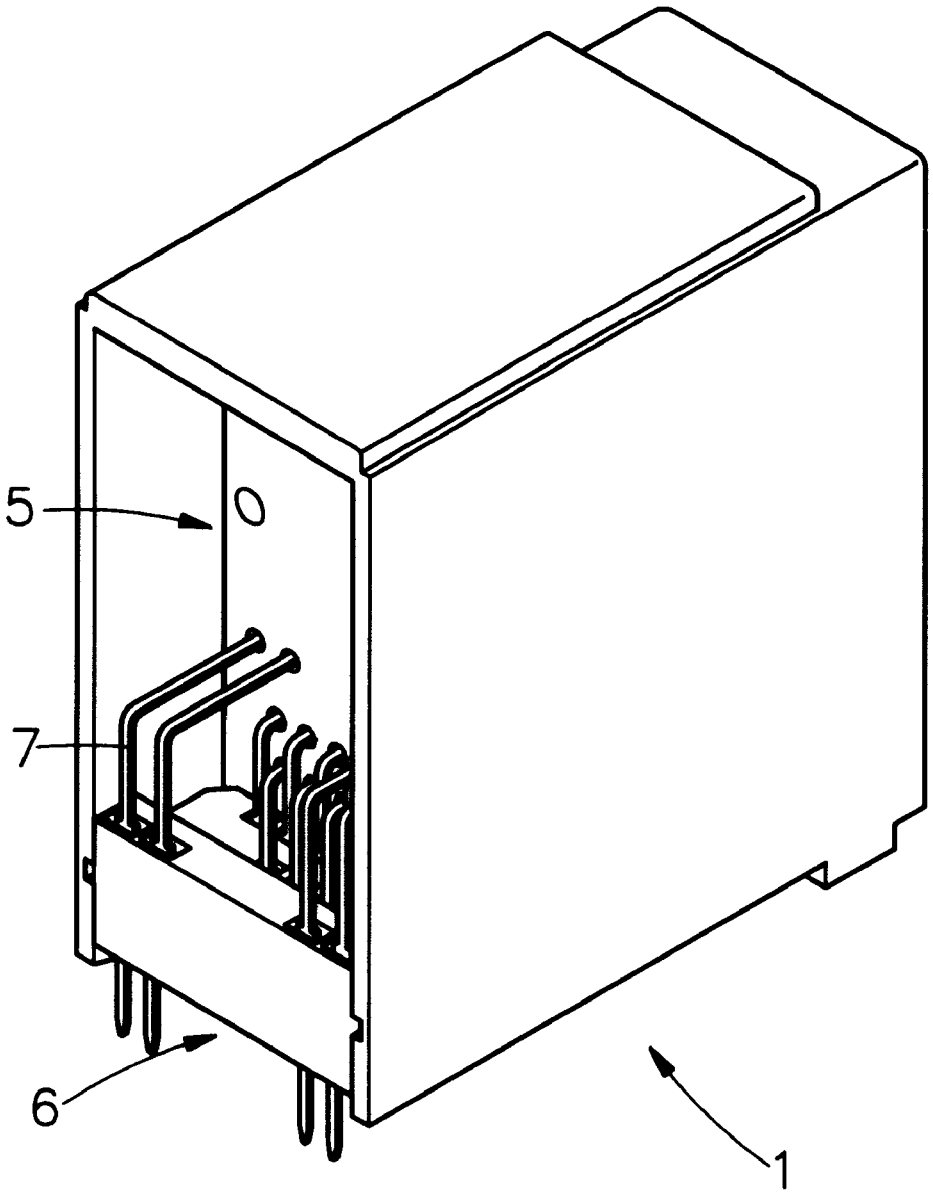
FIG.2 is an oblique rear side view of the electric connector according to the present invention.
Figure 3:
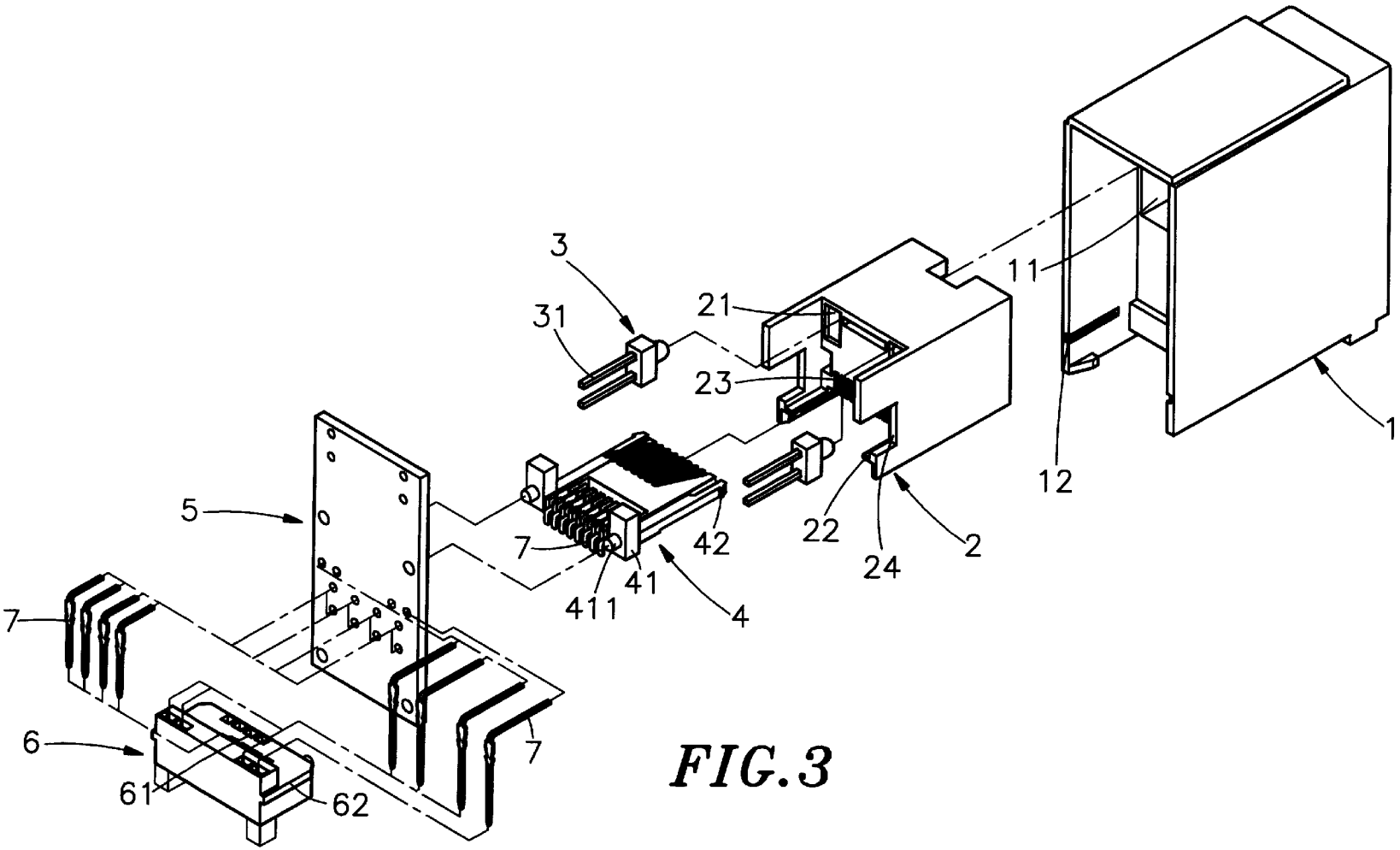
FIG. 3 is an exploded view of the electric connector according to the present invention.
Figure 4:
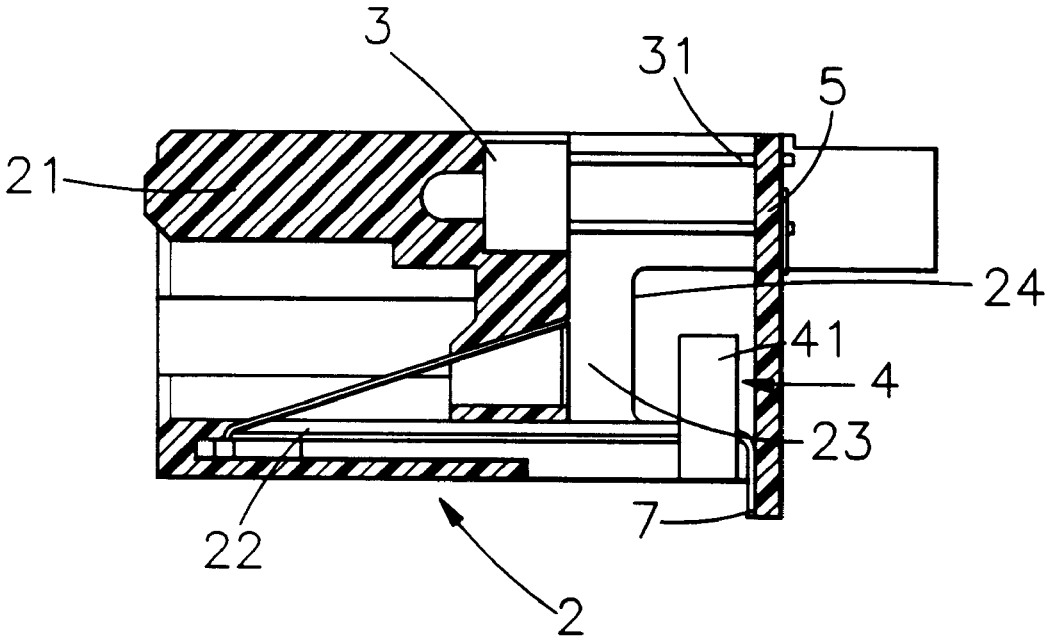
FIG. 4 is a side view in section of a part of the present invention.
Figure 5:
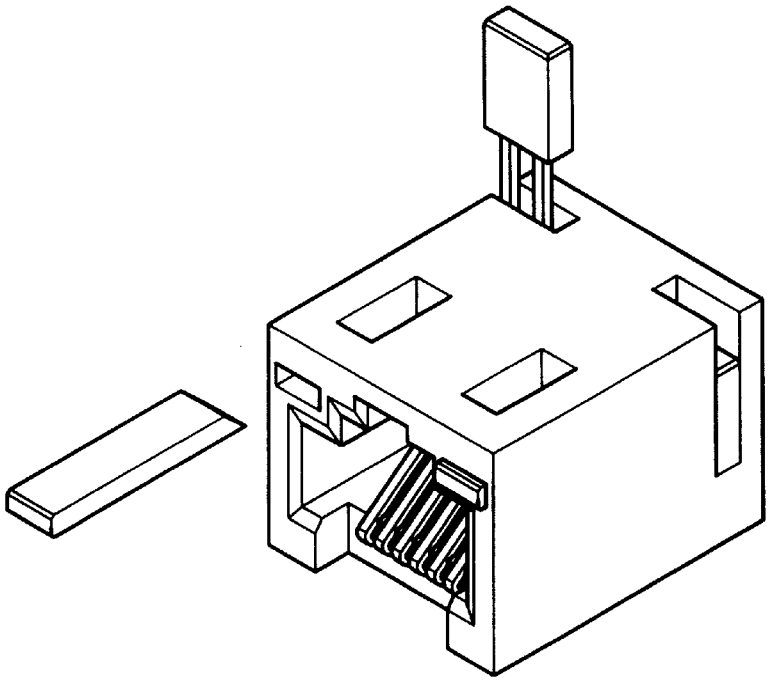
PRIOR ART FIG. 5
FIG. 5 is an exploded view of an electric connector according to the prior art.
Figure 6:
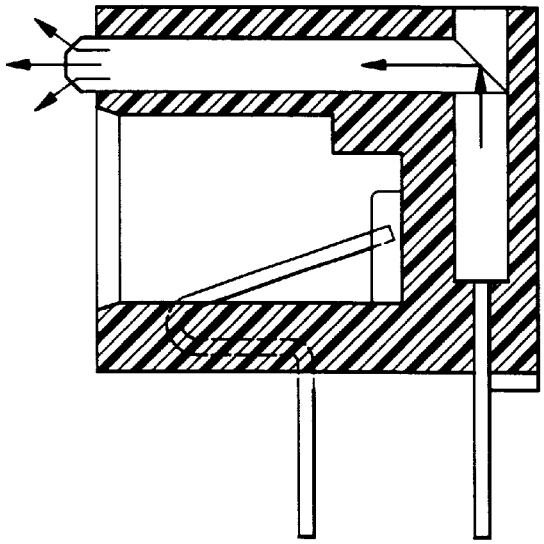
PRIOR ART FIG. 6
FIG. 6 is a sectional assembly view of the electric connector shown in FIG. 5.
Figure 7:
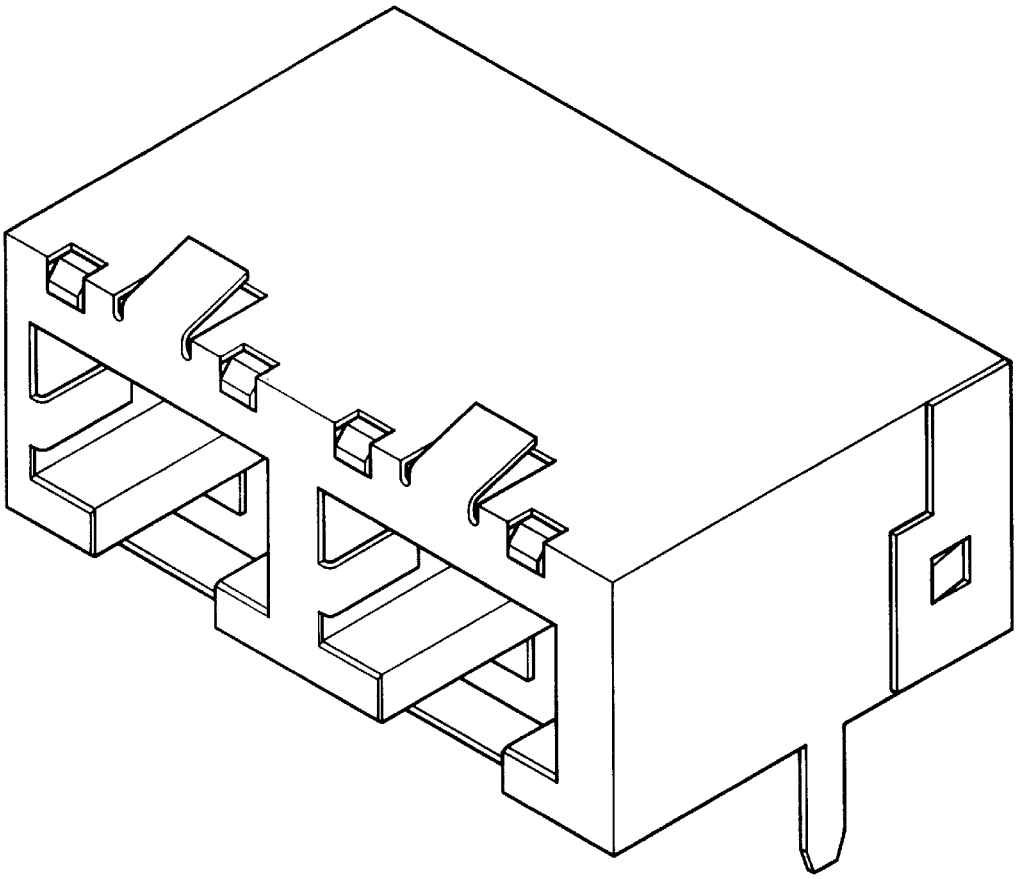
PRIOR ART FIG. 7
FIG. 7 is an elevational view of another structure of electric connector according to the prior art.
Figure 8:
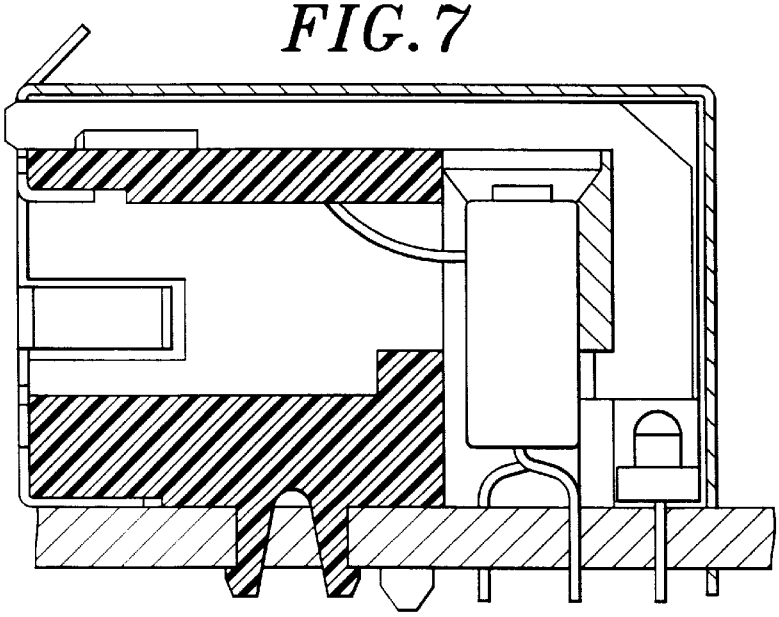
PRIOR ART FIG. 8
FIG. 8 is a sectional view in an enlarged scale of a part of FIG. 7.

Referring to FIGS. 1 through 4, an electric connector in accordance with the present invention is generally comprised of a housing 1, a socket shell 2, two light emitting elements 3, a terminal holder 4, a circuit board 5, a partition block 6, and two sets of terminals 7. One set, namely, the first set of terminals are installed in the terminal holder 4. The terminal holder 4 is inserted into two horizontal sliding grooves 22 in the socket shell 2, comprising two positioning hooks 42 bilaterally disposed at the rear side and respectively hooked on the rear side of each sliding groove 22. After installation of the terminal holder 4 in the socket shell 2, the first set of terminals 7 are respectively engaged into respective terminal grooves 23 in the socket shell 2. The light emitting elements 3 are installed in a respective lamp hole 21 in the socket shell 2. After installation of the first set of terminals 7 in the terminal holder 4 and the installation of the terminal holder 4 and the light emitting elements 3 in the socket shell 2, the socket shell 2 is press fitted into a receiving chamber 11 in the housing 1, and then the pins 31 of the light emitting elements 3 and the first set of terminals 7 are respectively welded to one side of the circuit board 5, keeping the circuit board 5 in vertical inside the housing 1. Further, the terminal holder 4 comprises two upright front blocks 41 respectively engaged into respective locating notches 24 of the socket shell 2. The upright front blocks 41 each have a locating pin 411 press-fitted into a respective positioning hole on the circuit board 5. The second set of terminals 7 are welded to the opposite sides of the circuit board 5, and then the partition block 6 is mounted in the housing 1 to hold the second set of terminals 7 in good order. The partition block 6 comprises two sliding rails 62 inserted into respective horizontal sliding grooves 12 in the housing 1, and a plurality of terminal slots 61 for the passing of the second set of terminals 7.

The socket shell 2 is made of transparent or semi-transparent material, therefore the socket shell 2 admits light. During the operation of the electric connector, the light emitting elements 3 are electrically connected to emit light. Light rays from the light emitting elements 3 pass through the body of the socket shell 2 to the visible front side of the socket shell 2. Therefore, the user can easily check the operation of the electric connector by visual. Further, the light emitting elements 3 can be, for example, light emitting diodes.

While only one embodiment of the present invention has been shown and described, it will be understood that various modifications and changes could be made thereunto without departing from the spirit and scope of the invention disclosed.

What the invention claimed is:

1. An electric connector comprising:

a housing;

a socket shell made of a light penetrable material and positioned in the housing, said socket shell having a cavity for receiving an electric plug;

a terminal housing retained by said socket shell and including a plurality of terminals mounted thereon;

at least one light emitting device;

wherein said socket shell includes a rear portion and a front face which is remote from said rear portion, said rear portion forming at least one slot dimensioned to accommodate the light emitting device; and wherein the light emitting device is positioned in the slot and extends in a direction perpendicular to the front face such that light from the light emitting device travels through said rear portion to reach said front face.

2. The electric connector of claim 1 wherein said socket shell is made of transparent material.

3. The electric connector of claim 1 wherein said socket shell is made of semi-transparent material.

4. The electric connector of claim 1 wherein said light emitting device comprises at least one light emitting diode.

5. The electric connector of claim 1 further comprising a circuit board installed in said housing and mounted onto one side of said rear portion of said socket shell, said plurality of terminals being welded to said circuit board.

* * * * *